US006203439B1

(12) United States Patent
Tychsen et al.

(10) Patent No.: US 6,203,439 B1
(45) Date of Patent: Mar. 20, 2001

(54) HYDRAULIC MACHINE

(75) Inventors: Tom Tychsen, Gråsten; Hans Christian Petersen, Nordborg; Claus Jesper Johansen, Sønderborg, all of (DK)

(73) Assignee: Danfoss Fluid Power A/S, Nordborg (DK)

( * ) Notice: Subject to any disclaimer, the term of this patent is extended or adjusted under 35 U.S.C. 154(b) by 0 days.

(21) Appl. No.: 09/096,059

(22) Filed: Jun. 11, 1998

(30) Foreign Application Priority Data

Jul. 1, 1997 (DE) ..... 197 27 887

(51) Int. Cl.[7] ..... F16D 3/18
(52) U.S. Cl. ..... 464/156; 464/158; 74/462
(58) Field of Search ..... 464/106, 109, 464/147, 149, 155, 156, 157, 158; 74/410, 462; 403/359.1, 359.6

(56) References Cited

U.S. PATENT DOCUMENTS

| | | | | |
|---|---|---|---|---|
| 2,744,449 | * | 5/1956 | Belden et al. | 464/158 |
| 2,922,294 | * | 1/1960 | Wildhaber | 464/158 |
| 2,927,510 | * | 3/1960 | Wilhaber | 464/158 |
| 3,243,973 | * | 4/1966 | Kraeling | 464/156 |
| 3,292,390 | * | 12/1966 | Wildhaber | 464/158 |
| 3,782,866 | * | 1/1974 | McDermott | 464/156 |
| 3,973,880 | * | 8/1976 | Swedberg | 464/156 X |
| 4,969,371 | * | 11/1990 | Allen | 464/157 |

FOREIGN PATENT DOCUMENTS

| | | | | |
|---|---|---|---|---|
| 570732 | * | 8/1977 | (SU) | 464/153 |
| 1076664 | * | 2/1984 | (SU) | 74/462 |
| 1357639 | * | 2/1984 | (SU) | 74/462 |

OTHER PUBLICATIONS

Merriam–Webster's Collegiate Dictionary, 10th ed., Merriam–Webster Inc., p. 285, 1993.*

* cited by examiner

*Primary Examiner*—Lynne H. Browne
*Assistant Examiner*—Greg Binda
(74) *Attorney, Agent, or Firm*—Lee, Mann, Smith, McWilliams, Sweeney & Ohlson

(57) ABSTRACT

A hydraulic machine with an orbiting displacement element connected unrotatably with an output shaft via an intermediary shaft, the intermediary shaft having at least at one end an external toothing, which engages an internal toothing, which permits a swivel motion of the intermediary shaft. The external toothing has teeth with concavely shaped tooth sides having a smaller curvature at the axial ends than in the area of the axial center.

10 Claims, 2 Drawing Sheets

HYDRAULIC MACHINE

BACKGROUND OF THE INVENTION

The invention concerns a hydraulic machine with an orbiting displacement element connected unrotatably with an output shaft via an intermediary shaft, the intermediary shaft having at least at one end an external toothing, which engages an internal toothing, which engagement permits a swivel motion of the intermediary shaft.

Such a machine is known from, for instance, U.S. Pat. No. 3,973,880.

Machines of this kind can, for example, be used as motors, pumps or steering units. The function of the output shaft depends on the desired application purpose. When the machine is used as a motor, the motor delivers its mechanical output via the output shaft. When the machine is used as a pump, it is driven by the output shaft. In the case of a steering unit, a steering handwheel can be connected with the output shaft.

In many cases the displacement element is made as a gear, which mates with a second displacement element made as a ring gear. During operation the displacement element does not only perform a pure rotational movement, it also orbits around the axis of the output shaft. An intermediary shaft, also called "dog-bone", is provided to enable the transmission of this rotational movement to the output shaft. This intermediary shaft must permit the required swivel motion.

SUMMARY OF THE INVENTION

In most cases the intermediary shaft is weaker than the displacement element and often also weaker than the output shaft. Thus it limits the load capacity of the machine.

The task of the invention is to increase the load capacity of the machine.

In a hydraulic machine of the kind mentioned in the introduction this task is solved in that the external toothing has teeth with concavely shaped tooth sides having a smaller curvature at the axial ends than in the area of the axial centre.

The curvature of the tooth sides is made so that the available surface is enlarged towards the axial ends of the teeth. Thus the surface pressure of the teeth, that is, the specific load on the tooth sides, is reduced towards the axial ends of the teeth. Towards the axial centre the surface is reduced, and thus the surface pressure, that is, the force divided by the surface increases. Here, however, the tooth is thicker, so that it can more easily stand the load. In the cases known till now, the conditions were practically the opposite. Here the surface pressure increased towards the axial ends of the teeth, which naturally more easily gave rise to the risk of a damage. The fact that the tooth sides are concavely curved eliminates the necessity of creating a sharp inner edge. This reduces the risk of a notch effect, which again increases the load capacity. A resulting additional advantage is a less wear intensive and more stable operating behaviour, as, all other things being equal, the teeth and the corresponding opposite toothing bear on each other with a reduced surface pressure. With this new embodiment the load can practically be doubled, provided that the remaining dimensioning is the same. This is partly a result of the reduction of the notch factor, which contributes substantially to the reduction of the stress level. Another considerable contribution lies in the improved support or carrying behaviour of the profile when compared with a profile with "sharp" teeth on the intermediary shaft.

Preferably, the tooth sides of adjacent teeth are connected with each other through a continuously extending profile.

Thus, also the bottom of the tooth clearance can be included in the curvature. This gives a step-free and bend-free connection of the tooth sides, which improves the operating properties and the wearibility and increases the load capacity.

Advantageously, in any axial position the profile has the same curvature as the tooth sides. Each section vertical to the axial direction will thus result in a permanently differentiable curve, on which the corresponding opposite teeth of the internal toothing can roll off well.

In a particularly preferred embodiment it is provided that substantially the shapes of the tooth clearances are formed through parts of the cylindrical surface areas of opposed cone frustums. When making a section parallel to the axis of the intermediary shaft, the bottom of the tooth clearances consists of two straight lines inclined in opposite directions. For production technical reasons small deviations from the shape of an exact straight line are of course permitted. However, in the axial direction the profile no longer has distinct curvatures. A condition for this merely is that the inclinations are adapted to the swivel angle of the intermediary shaft in relation to the displacement element or the output shaft, respectively. Thus, the load can be distributed relatively evenly on half the axial extension of each tooth side, which again reduces the surface pressure.

Advantageously, the bottom in the middle of the tooth clearance has an inclination in the range from 1° to 10°, particularly from 1° to 3.5°, in relation to the axis of the intermediary shaft. Such angles have proved to be expedient. In most cases they are perfectly sufficient to permit the orbiting of the displacement element.

Advantageously, the external toothing has a number of teeth in the range from 3 to 20, particularly from 8 to 12. This results in engagement angles in the range from 30° to 45°. Engagement angles of this size will give the teeth the longest life. Normally this results in a relatively stable operation behaviour.

Advantageously, in the axial direction the internal toothing has a constant shape. Due to the embodiment of the external toothing of the intermediary shaft, the internal toothing of the displacement element or the output shaft, respectively, can now be made so that it does not change in the axial direction. This gives an even better adaptation of the internal toothing to the external toothing.

It is particularly preferred that substantially the shapes of the teeth of the internal toothing are formed through a part of the cylindrical surface area of a cylinder. Indeed this will lead to the situation that on transition from tooth side to tooth clearance a bend will occur, which could cause a notch effect. However, this is not as critical as it would be on the intermediary shaft, as here the component dimensions can be correspondingly larger and more resistant.

BRIEF DESCRIPTION OF THE DRAWINGS

In the following the invention is described on the basis of preferred embodiments in connection with the drawings, showing.

DESCRIPTION OF THE PREFERRED EMBODIMENT

Figure 1:
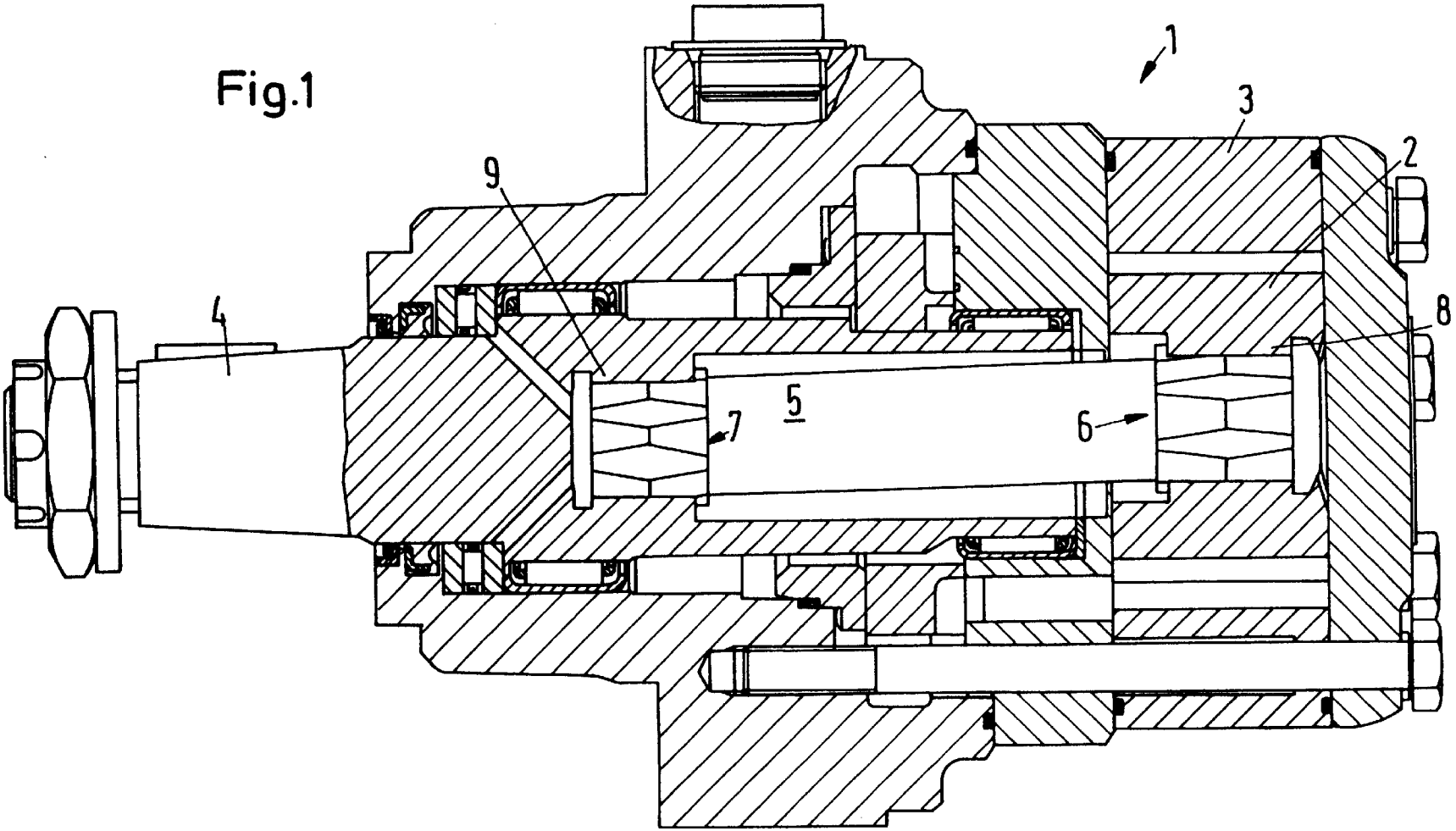
FIG. 1 a schematic longitudinal section through a hydraulic machine

A hydraulic machine 1, in the present case a motor, has a first displacement element 2 made as a gear co-operating with a second displacement element 3 made as a ring gear. For this purpose the gear 2 rotates while simultaneously orbiting around an axis, that is, the centre of the gear 2 performs a rotation around this axis.

Said axis is at the same time the axis of an output shaft 4, with which the displacement element 2 is unrotatably connected via an intermediary shaft 5. on one rotation of the displacement element 2 the intermediary shaft 5 must be able to perform a certain swivel movement, that is, it must be articulately connected with the displacement element 2.

To be able to perform this swivel movement, both axial ends of the intermediary shaft have an external toothing 6, 7, the external toothing 6 engaging a schematically shown internal toothing 8 on the displacement element 2 and the external toothing 7 engaging an internal toothing 9 on the output shaft 4.

The shape of the external toothing will now be explained on the basis of FIG. 2. However, particularly for the purpose of explaining the inclination angle, the sizes of the details drawn have been exaggerated.

Figure 2:
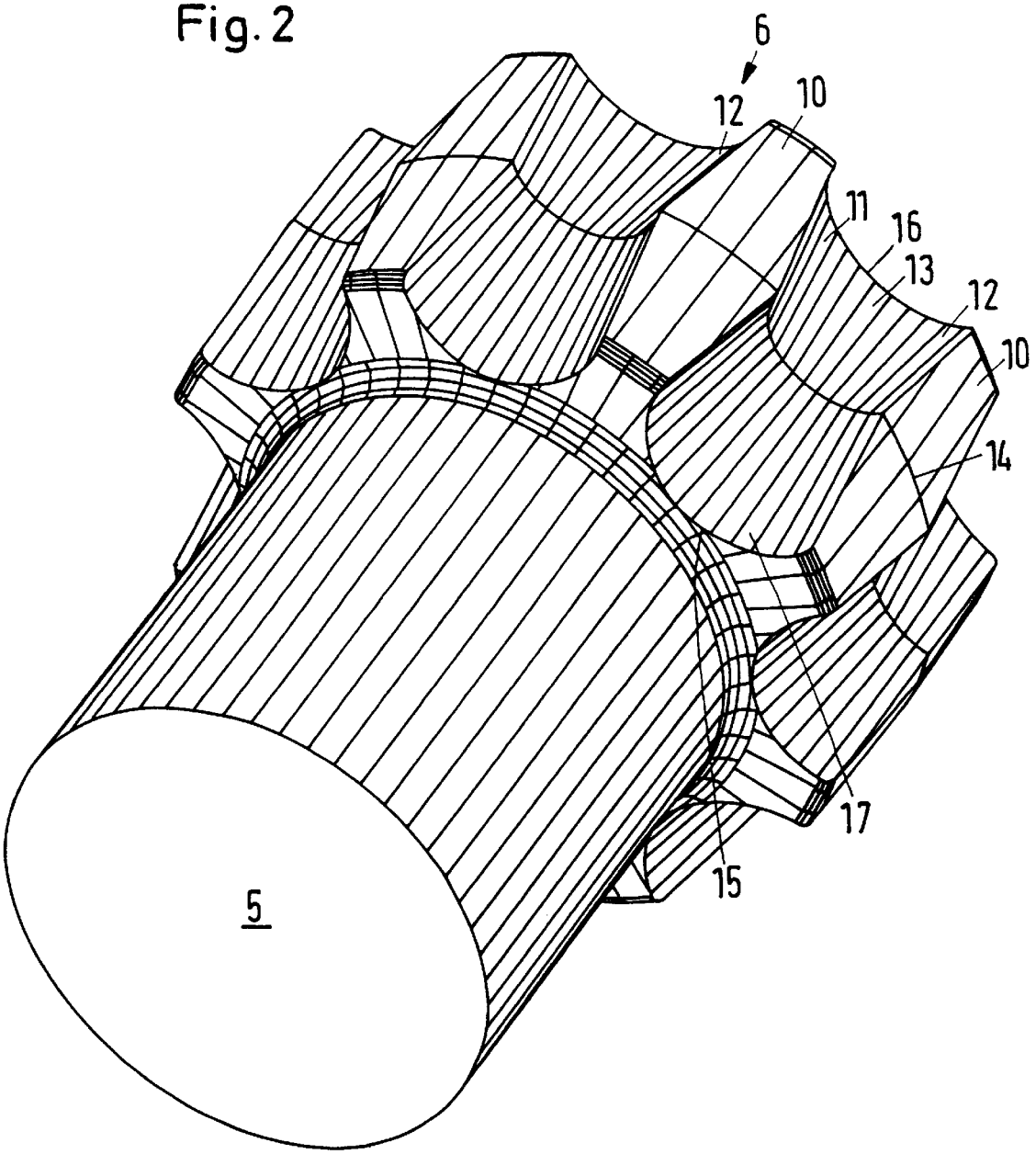
FIG. 2 a perspective view of an end of an intermediary shaft with external toothing.

The external toothing 6 of the intermediary shaft 5 shown in FIG. 2 has several teeth 10 having tooth sides 11 and 12. The tooth sides 11, 12 are curved concavely. The tooth sides 11, 12 of adjacent teeth extend into each other, that is, the concave curvature continues also in the bottom 13 of the tooth clearances.

The curvature of the tooth sides 11, 12 and the bottom 13 of the tooth clearance is shaped so that it expands from the axial centre 14 of the tooth structure towards the axial ends 15, 16. This is illustrated in that the distances between the substantially axially extending lines 17 representing the curvature are larger at the axial ends 15, 16 than in the axial centre 14 of the external toothing 6. This means that also the available surface on the tooth sides 11, 12 grows in the direction of the axial ends 15, 16 of the toothing, so that with constant forces the surface pressure will be reduced.

In any axial position of the profile of the tooth clearance, which surrounds the tooth sides 11, 12 and the bottom 13, a substantially constant curvature is available. If, in such a position, a section was made vertically to the axial direction, the section of the profile would practically have the shape of a curved line. Thus, the surface covering the tooth sides 11, 12 and the bottom 13, is formed through a part of the cylindrical surface areas of two opposed cone frustums.

This means that the bottom 13 in the centre between two teeth 10 has a certain inclination in relation to the axis of the intermediary shaft 5. In the present case the inclination angle is in the range from 1° to 3.5°. It depends on the inclination, which is assumed by the intermediary shaft 5 in relation to the axis of the shaft 4 during operation. However, as already said, the dimensions in FIG. 2 are heavily exaggerated.

The counter-toothing co-operating with the external toothing, that is, for example, the internal toothing 8 on the displacement element 2, can easily be formed through teeth, which have the shape of cylinders, which are partly embedded in the displacement element 3. Thus their shape does not change in the axial direction. Due to their shape they co-operate well, with low wear and high load capacity, with the external toothing shown in FIG. 2.

Expediently, the external toothing 6, 7 has eight to twelve teeth.

What is claimed is:

1. Hydraulic machine with an orbiting displacement element connected unrotatably with an output shaft via an intermediary shaft, the intermediary shaft having at least at one end an external toothing, which engages an internal toothing, which engagement permits a swivel motion of the intermediary shaft, the external toothing having teeth with concavely shaped tooth sides having a smaller curvature at opposite axial ends of the teeth than in an area of axial centre of the teeth.

2. Machine according to claim 1, in which the tooth sides of adjacent teeth are connected with each other through a continuously extending profile.

3. Machine according to claim 2, in which in any axial position a profile through the teeth has the same curvature as the tooth sides.

4. Machine according to claim 1, in which the teeth have tooth clearances formed through parts of cylindrical surface areas of opposed cone frustums.

5. Machine according to claim 4, in which each tooth clearance has a bottom formed at an inclination in a range from 1° to 10° in relation to the axis of the intermediary shaft.

6. Machine according to claim 5, in which the range is from 1° to 3.5°.

7. Machine according to claim 1, in which the external toothing has a number of teeth in the range from 3 to 20.

8. Machine according to claim 7 in which the number of teeth is from 8 to 12.

9. Machine according to claim 1, in which in the axial direction the internal toothing has a constant shape.

10. Machine according to claim 9, in which substantially the shapes of the teeth of the internal toothing are formed through a part of the cylindrical surface areas of a cylinder.

* * * * *